US007334915B2

(12) United States Patent
Kim

(10) Patent No.: US 7,334,915 B2
(45) Date of Patent: Feb. 26, 2008

(54) SEARCHLIGHT GRIP

(75) Inventor: Paul Y. Kim, Santa Ana, CA (US)

(73) Assignee: Surefire, LLC, Fountain Valley, CA (US)

( * ) Notice: Subject to any disclaimer, the term of this patent is extended or adjusted under 35 U.S.C. 154(b) by 148 days.

(21) Appl. No.: 11/034,004

(22) Filed: Jan. 11, 2005

(65) Prior Publication Data

US 2006/0158884 A1 Jul. 20, 2006

(51) Int. Cl.
*F21L 4/04* (2006.01)

(52) U.S. Cl. ..... 362/205; 362/177

(58) Field of Classification Search ..... 362/205, 362/199

See application file for complete search history.

(56) References Cited

U.S. PATENT DOCUMENTS 5,541,822 A * 7/1996 Bamber ..... 362/190
5,558,430 A 9/1996 Booty, Jr. ..... 362/184
5,988,828 A * 11/1999 Prince et al. ..... 362/199
6,283,609 B1 * 9/2001 Parsons et al. ..... 362/187
6,388,390 B2 * 5/2002 Rachwal ..... 315/200 R
6,474,833 B1 * 11/2002 Parsons et al. ..... 362/205
6,641,279 B1 * 11/2003 Williams ..... 362/184
6,793,366 B2 * 9/2004 Chun ..... 362/184
6,913,371 B2 * 7/2005 Ping ..... 362/199
2004/0050188 A1 * 3/2004 Richards et al. ..... 73/866.3
2004/0140911 A1 * 7/2004 Chen ..... 340/908
2005/0122714 A1 * 6/2005 Matthews et al. ..... 362/206

* cited by examiner

*Primary Examiner*—Hargobind S. Sawhney

(57) ABSTRACT

A multi-position switched grip for a searchlight includes a two-ended hand-grip. Each end has a thumb-operable push-button switch. A person holds the grip between palm and fingers with thumb on one or the other switch. One end has a hinge to which are connected an electrical power receptacle and a lamp mount. The hinge has a release which is normally biased to lock the hinge in one or the other of two orientations relative to the grip body. Pressing the release inward unlocks the hinge and allows the stein to rotate between the two orientations. The switches are configured and electrically connected such that pressing either switch once and releasing it alternates the searchlight between the ON and OFF conditions.

21 Claims, 9 Drawing Sheets

40
100
98
96
104
110
102
106
106
108
78
170
94
86
82
94
74
92
128
76
94
114
140
124
130
132
126
120
116
124
122
170
84
34
80
94
88
72
90
144
156
150
158
142
152
164
154
166
156
168
146
160
148
172
162
122
124
118
140
116
126
128
132
134
136
138
130

40
100
96
102
111
112
108

SEARCHLIGHT GRIP

BACKGROUND OF THE INVENTION

1. Field of the Invention

The present invention relates to a searchlight for use in combat, search and rescue, or inclement weather, more particularly to a searchlight having an adjustable-angle hand grip, and especially to such a grip which includes switches for operating the searchlight.

2. Description of the Related Art

A person using a searchlight in an emergency or combat situation may prefer to have the searchlight mounted on a hand grip. To direct the beam of light forward while holding the searchlight in hand with one's forearm horizontal, one would prefer the searchlight to be attached substantially perpendicular to the beam. The grip may be held either with the light above the hand, or with the light below the hand, depending only on which way the grip is held. To direct the beam forward while holding the searchlight in hand with one's forearm vertical, one would prefer the searchlight to be attached substantially parallel to the beam. The grip may then be held either with the forearm extended upward, above the person's shoulder, with the beam projecting forward, or with the forearm extended downward, at the person's side, and the beam projecting forward. Transition between these two positions involves reversing the person's hold on the grip.

A person using such a searchlight also prefers to know in advance where the on-off switch is, how to reach it, and how to operate it without inspecting it or experimenting with it. In the above-described situation, it would be helpful to find the switch in substantially the same place and to operate it in substantially the same manner regardless of which way one holds the grip and of how the grip is oriented relative to the searchlight.

SUMMARY OF THE INVENTION

It is an object of the present invention to provide a tactically adapted multi-position switched searchlight grip whose switching means are hand-operable by substantially the same acts, independent of how the grip is oriented relative to the searchlight and independent of the orientation in which a person holds the grip.

In accordance with these objects and with others which will be described and which will become apparent, an exemplary embodiment of a multi-position searchlight grip in accordance with the present invention includes an elongated grip body; a first end formed on the grip body and including a first actuator; a second end formed on the grip body and including a second actuator and means for attaching a lamp to the grip body; and means for connecting the first actuator and the second actuator to control illumination of a lamp that is attached to the body.

In another exemplary embodiment of a multi-position switched searchlight grip in accordance with the present invention, each of the first actuator and the second actuator includes a thumb-operable push-button.

In another exemplary embodiment, each push-button is operatively connected to a switch and each switch is operatively connected to the means for connecting.

In another exemplary embodiment, each switch is an electrical switch electrically connected to the means for connecting.

In another exemplary embodiment, the means for connecting are operatively connected in substantially the same manner to each of the first actuator and the second actuator.

In another exemplary embodiment, the means for connecting include a stem rotatably connected to the second end and a lamp mount formed on the stem.

In another exemplary embodiment, the means for connecting include an electrical circuit including a first power input, a second power input, a first power output, and a second power output. The means for connecting are operable in an ON state wherein the first power input is electrically connected to one of the first power output and the second power output, and the second power input is connected to the other of the first power output and the second power output. The means for connecting are also operable in an OFF state, wherein at least one of the first power input and the second power input is electrically disconnected from both of the first power output and the second power output; and a single operation of one of the first actuator and the second actuator causes the means for connecting to alternate from one to the other of the ON state and the OFF state.

In another exemplary embodiment, each of the first actuator and the second actuator includes a push-button.

In another exemplary embodiment, each push-button is operatively connected to a switch and each switch is operatively connected to the means for connecting.

In another exemplary embodiment, each switch is an electrical switch electrically connected to the means for connecting.

In another exemplary embodiment, the means for connecting include a stem rotatably connected to the second end and a lamp mount formed on the stem.

Also in accordance with these objects, an exemplary embodiment of a multi-position grip for a searchlight, tool, weapon, or the like in accordance with the present invention includes a grip body, a lamp portion operatively coupled to the grip body, and a hinge pin movably disposed through the grip body and through the lamp portion. The the hinge pin has a first position, wherein the hinge pin rotationally fixes the lamp portion to the grip body, and a second position, wherein the lamp portion is rotatable relative to the grip body.

In another exemplary embodiment, the hinge pin is biased in the first position and displaceable to the second position in response to applied pressure.

In another exemplary embodiment, one of the lamp portion and the grip body has a tongue, the other of them has a yoke, and the tongue is disposed in the yoke.

In another exemplary embodiment, the hinge pin is disposed through the tongue and the yoke and cooperates with the tongue and the yoke to define an axis of rotation of the tongue relative to the yoke.

In another exemplary embodiment, the hinge pin is rotationally fixed relative to the yoke and is movable, parallel the axis of rotation, relative to the yoke, between the first position and the second position. In this exemplary embodiment, the hinge pin may also be biased in the first position and displaceable to the second position in response to applied pressure.

Another exemplary embodiment includes a push-button located on the grip body and proximate the hinge pin, the push-button being operatively coupled to the lamp portion for controlling the lamp portion.

BRIEF DESCRIPTION OF THE DRAWINGS

For a further understanding of the objects and advantages of the present invention, reference should be had to the following detailed description, taken in conjunction with the accompanying drawing, in which like parts are given like reference numbers and wherein.

DESCRIPTION OF THE PREFERRED EMBODIMENTS

Figure 1:
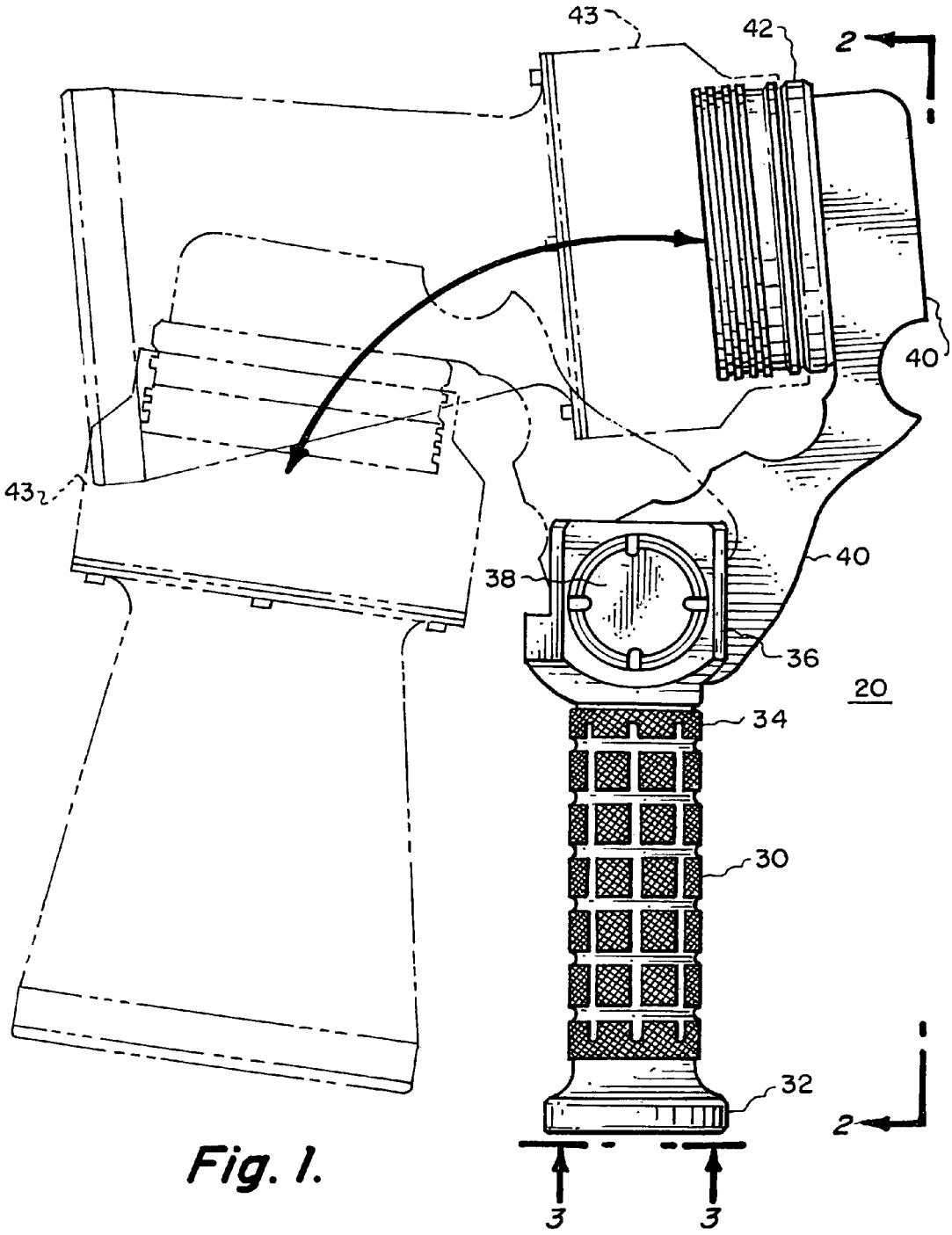
FIG. 1 is a side view a preferred embodiment of a multi-position searchlight grip 20 in accordance with the present invention.

The invention will now be described with reference to FIG. 1, which illustrates in side view a preferred embodiment of a multi-position searchlight grip 20 in accordance with the present invention, comprising an elongated metal grip body 30 having a first end 32 and a second end 34. The second end 34 includes a metal hinge portion 36 having a release 38. A metal stem 40 projects from the hinge portion 36 and forms a metal lamp mount 42 which is threaded for engagement with an interchangeable lamp 43 (drawn in phantom).

With continued reference to FIG. 1, the release 38 is normally biased to lock the hinge portion 36 and thus fix the stem 40 in either of two orientations relative to the grip body 30. Responsive to externally applied pressure, the release 38 is displaceable parallel to the axis of rotation of the hinge portion 36 whereupon the release 38 unlocks the hinge portion 36. When the hinge portion 36 is unlocked, a force applied to the stem 40 may rotate stem 40 out of one orientation. When the stem 40 reaches the other orientation, the release 38, being biased, will lock the hinge portion 36, again fixing the stem 40 relative to the grip body 30. A person may grasp and stabilize the grip body 30 by encircling it with the fingers and palm of one hand, and may use the other hand to press the release 38 and to rotate the stem 40 relative to the grip body 30. For improved grasp and control, the grip body 30 is notched and textured and the first end 32 and second end 34 are enlarged relative to the grip body 30.

Figure 2:
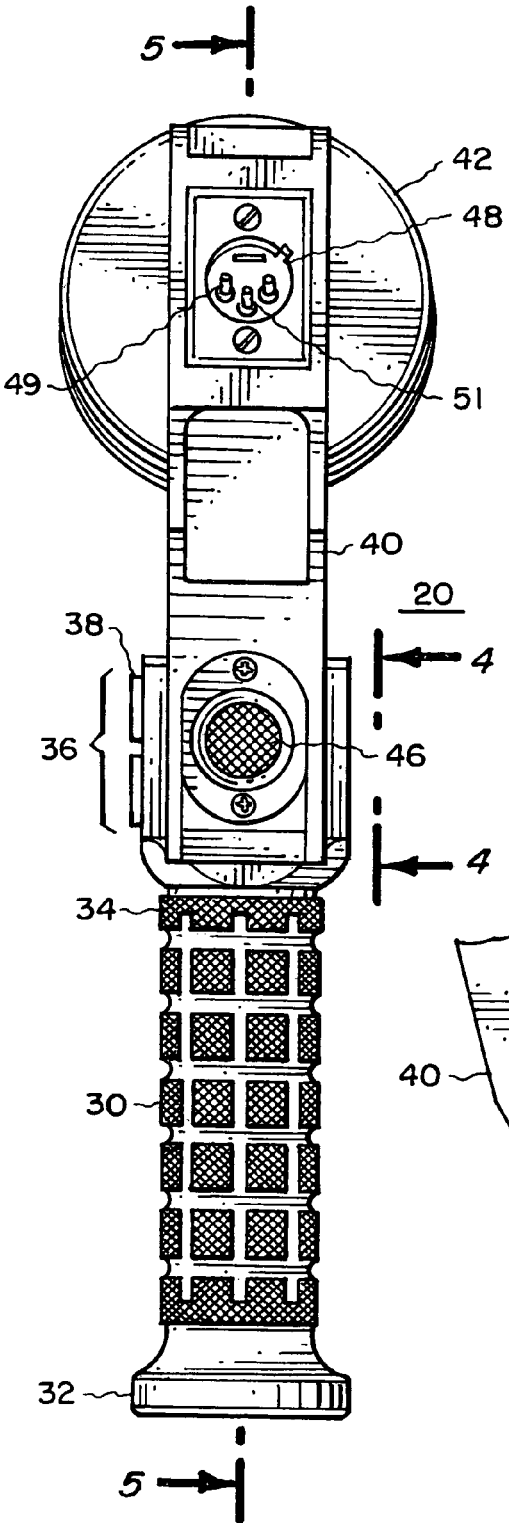
FIG. 2 is rear view of the grip of FIG. 1 taken along line 2-2 of FIG. 1 in the direction of the appended arrows.
Figure 3:
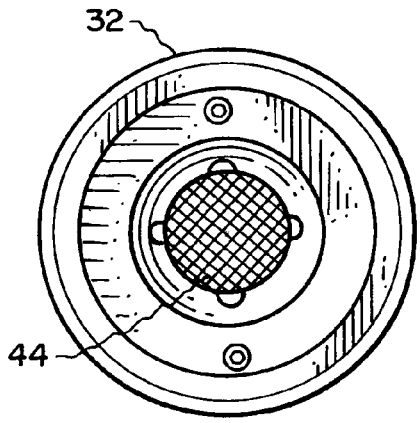
FIG. 3 is a bottom view of a first end of the grip of FIG. 1 taken along line 3-3 of FIG. 1 in the direction of the appended arrows.

FIG. 2 is a rear view taken along line 2-2 of FIG. 1. FIG. 3 is a bottom view of the first end 32 taken along line 3-3 of FIG. 1. Taken together, FIG. 2 and FIG. 3 show the first end 32, the grip body 30, the second end 34, the hinge portion 36, the release 38, the stem 40, and the lamp mount 42. As shown in FIG. 3, the first end 32 has a first actuator which includes a downward-facing first pushbutton cover 44. As shown in FIG. 2, the stem 40 has a rearward-facing electric power receptacle 48 having a plurality of rearward-projecting electrical contact pins including a positive power input contact pin 49 and a negative power input contact pin 51.

Figure 4:
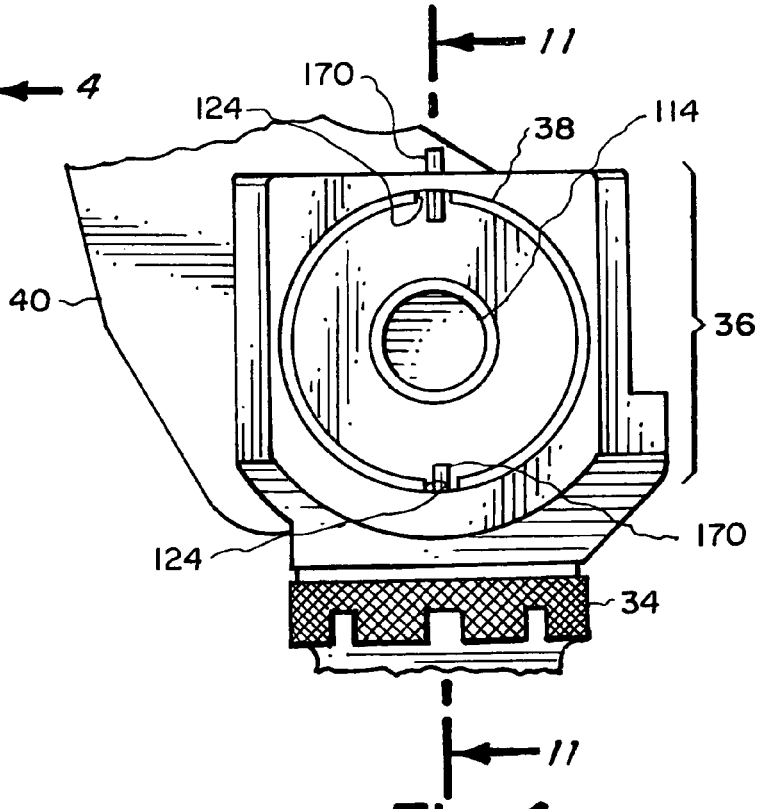
FIG. 4 an enlarged side view of a hinge taken along line 4-4 of FIG. 2 in the direction of the appended arrows.

FIG. 4, an enlarged side view of the hinge portion 36 taken along line 4-4 of FIG. 2, shows the second end 34, the hinge portion 36, and the stem 40. Also shown are the hinge pin 114 and the head 116 thereof having retainer notches 124 in which are disposed retainer pins 170.

Figure 5:
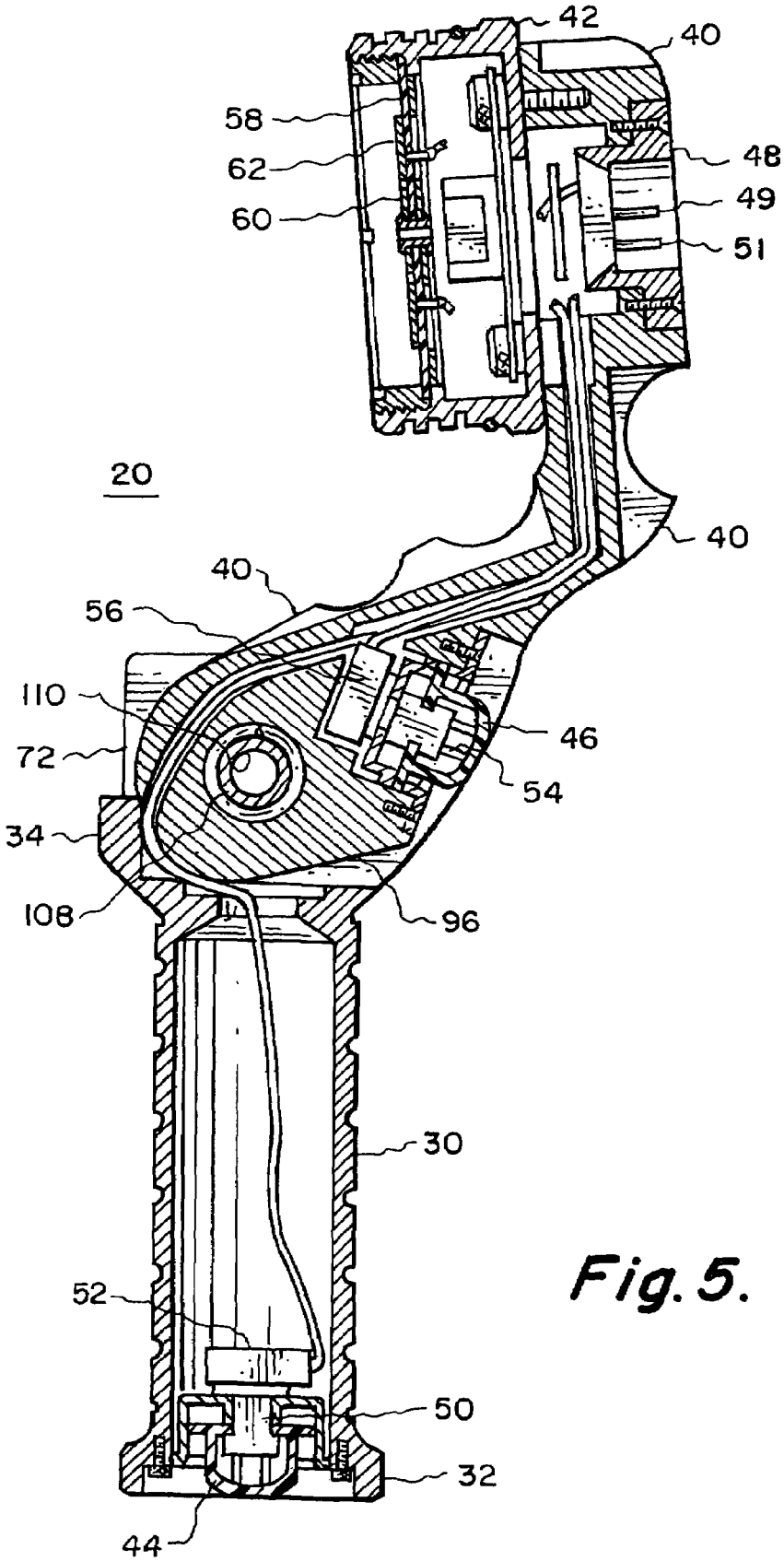
FIG. 5 is a side sectional view of the grip of FIG. 2 taken along line 5-5 of FIG. 2 in the direction of the appended arrows.

FIG. 5, a side sectional view taken along line 5-5 of FIG. 2, shows the first end 32 with the first pushbutton cover 44 and the first plunger 50 and first switch 52; the grip body 30; and the second end 34 including a yoke 72 in which is disposed a tongue 96. The tongue 96 has a central wall 108 which forms a left transverse center bore 110. Attached to the yoke 96 is a stem 40 with the second actuator including a second pushbutton cover 46, the second plunger 54 and the second switch 56; the receptacle 48 with the positive power input contact pin 49 and the negative power input contact pin 51; and the lamp mount 42.

With continued reference to FIG. 5, a first plunger 50 connects the first pushbutton cover 44 to a first switch 52 housed within the first end 32 of the grip body 30. A second plunger 54 connects the second pushbutton cover 46 to a second switch 56 housed within the stem 40 above and rearward of the hinge portion 36. The first switch 52 and the second switch 56 are electrically connected to the receptacle 48 and to the lamp mount 42, as will be discussed in greater detail hereinbelow.

With continued reference to FIG. 5, a round, flat, rigid, electrically insulating mounting board 58 is disposed in the lamp mount 42. The mounting board 58 includes a forward-facing central contact plate 60 and, radially spaced apart therefrom, an electrically discrete forward-facing peripheral contact ring 62. The peripheral contact ring 62 is electrically wired to the negative power input contact pin 51. It will be understood that the lamp module (shown only in FIG. 1, in phantom) is provided with electrical contacts (not shown) disposed at radii appropriate for establishing electrical continuity with the central contact plate 60 and the peripheral contact ring 62 when the lamp module is threaded onto the lamp mount 42.

Figure 6:
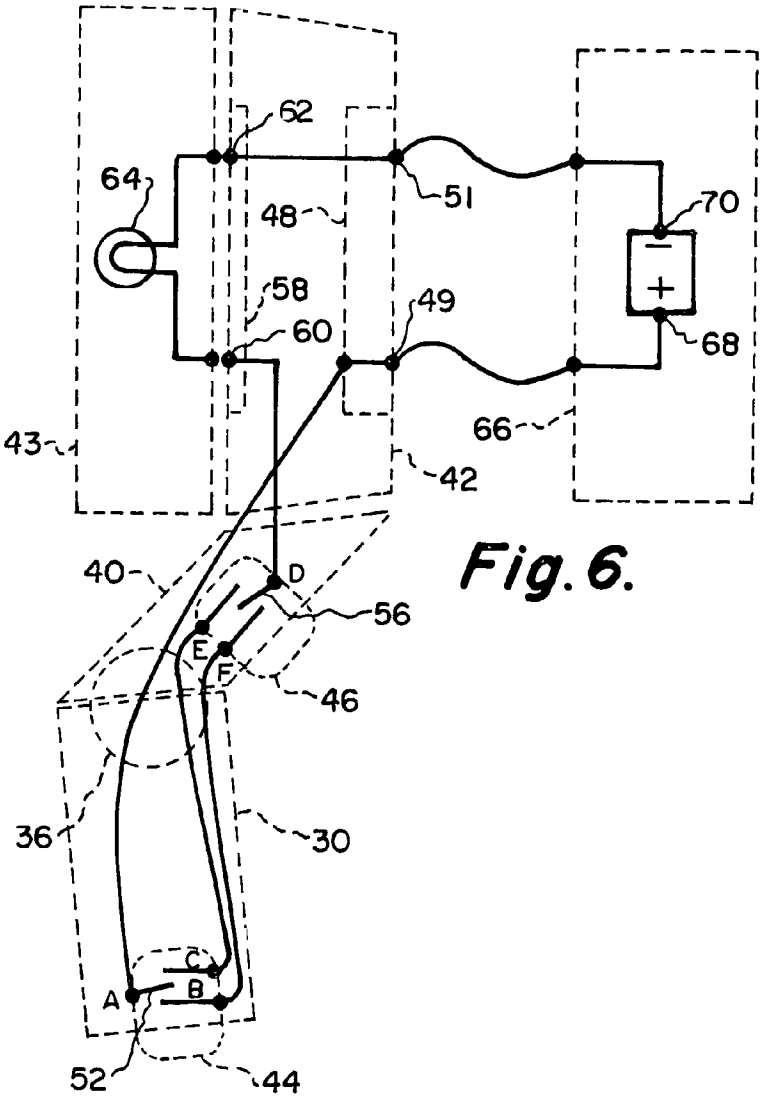
FIG. 6 is a schematic diagram of the electrical interconnection of an exemplary embodiment of a multi-position searchlight grip 20 in accordance with the present invention.

With continued reference to FIG. 5 and now also with reference to FIG. 6, a schematic diagram of the circuit of an exemplary embodiment of a multi-position searchlight grip 20 in accordance with the present invention, the electrical interconnections are described. FIG. 6 shows the grip body 30 with the first pushbutton cover 44 and the first switch 52; the hinge portion 36; the stem 40 with the second pushbutton cover 46 and the second switch 56; the lamp mount 42 with the receptacle 48 and the mounting board 58; and the lamp module 43 containing a light source 64. Also shown is an external power module 66 including a positive power output 68 and a negative power output 70. The positive power input contact pin 49 is electrically connected to the positive power output 68. The negative power input contact pin 51 is electrically connected to the negative power output 70.

With continued reference to FIGS. 5 and 6, the first switch 52 has three electrical contacts which are not shown in FIG. 5, but which are shown in FIG. 6 as contacts A, B, and C. Contact A is electrically connected to the positive power input contact pin 49 by a wire which passes from the first switch 52 through the grip body 30 and the stem 40 to the receptacle 48. The second switch 56 has three electrical contacts, also not shown in FIG. 5, shown in FIG. 6 as contacts D, E, and F. Contact D is electrically connected to the central contact plate 60 by a wire which passes from the second switch 56 through the stem 40 to the mounting board 58 inside the lamp mount 42. Contact B is electrically connected to contact F by a wire which passes from the first switch 52 through the grip body 30 to the second switch 56 in the stem 40. Contact C is electrically connected to contact E by a wire which passes from the first switch 52 through the grip body 30 to the second switch 56 in the stem 40. The first switch 52 connects contact A to one and only one of contact B and contact C and alternates between these connections each time the first plunger 50 is depressed and released. The second switch 56 connects contact D to one and only one of contact E and contact F and alternates between these connections each time the second plunger 54 is depressed and released.

With continued reference to FIG. 6, the reader will deduce that a change in position of either the first switch 52 or the second switch 56 will open the circuit A-D if it is closed, or close it if it is opened. Thus, pressing either the first switch 52 or the second switch 56 will alternate between connecting the light source 64 to the external power module 66 and disconnecting it therefrom.

Figure 7:
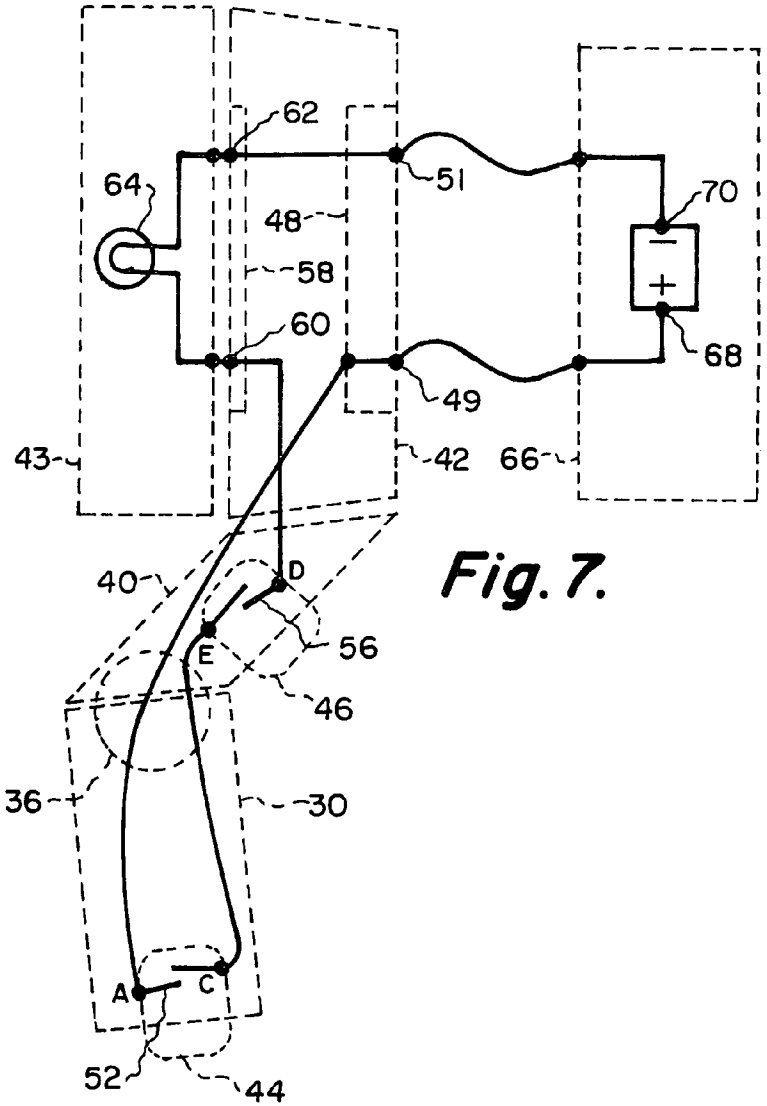
FIG. 7 is a schematic diagram of the electrical interconnection of an alternative embodiment of a multi-position searchlight grip 20 in accordance with the present invention.

FIG. 7 shows a schematic diagram of the circuit of an alternative embodiment of a multi-position searchlight grip 20 in accordance with the present invention. As does FIG. 6, FIG. 7 shows the grip body 30 with the first pushbutton cover 44 and the first switch 52; the hinge portion 36; the stem 40 with the second pushbutton cover 46 and the second switch 56; the lamp mount 42 with the receptacle 48 and the mounting board 58; and the lamp module 43 containing a light source 64. Also shown is an external power module 66 including a positive power output 68 and a negative power output 70. The positive power input contact pin 49 is electrically connected to the positive power output 68. The negative power input contact pin 51 is electrically connected to the negative power output 70.

With continued reference to FIG. 7, the first switch 52 has two electrical contacts which are not shown in FIG. 5, but which are shown in FIG. 7 as contacts A and C. Contact A is electrically connected to the positive power input contact pin 49 by a wire which passes from the first switch 52 through the grip body 30 and the stem 40 to the receptacle 48. The second switch 56 has two electrical contacts, also not shown in FIG. 5, shown in FIG. 7 as contacts D and E. Contact D is electrically connected to the central contact plate 60 by a wire which passes from the second switch 56 through the stem 40 to the mounting board 58 inside the lamp mount 42. Contact C is electrically connected to contact E by a wire which passes from the first switch 52 through the grip body 30 to the second switch 56 in the stem 40. The first switch 52 alternately closes and opens electrical connection of contact A to contact C each time the first plunger 50 is depressed and released. The second switch 56 alternately closes and opens electrical connection of contact D to contact E each time the second plunger 54 is depressed and released.

With continued reference to FIG. 7, the reader will deduce that both the first switch 52 and the second switch 56 must be closed in order for current to flow. Some users may prefer this arrangement to reduce the likelihood of unintended premature illumination in situations where it would have unmanageable consequences. First one switch, then the other, would have to be activated, before the light would shine.

Figures 8, 9, 10:
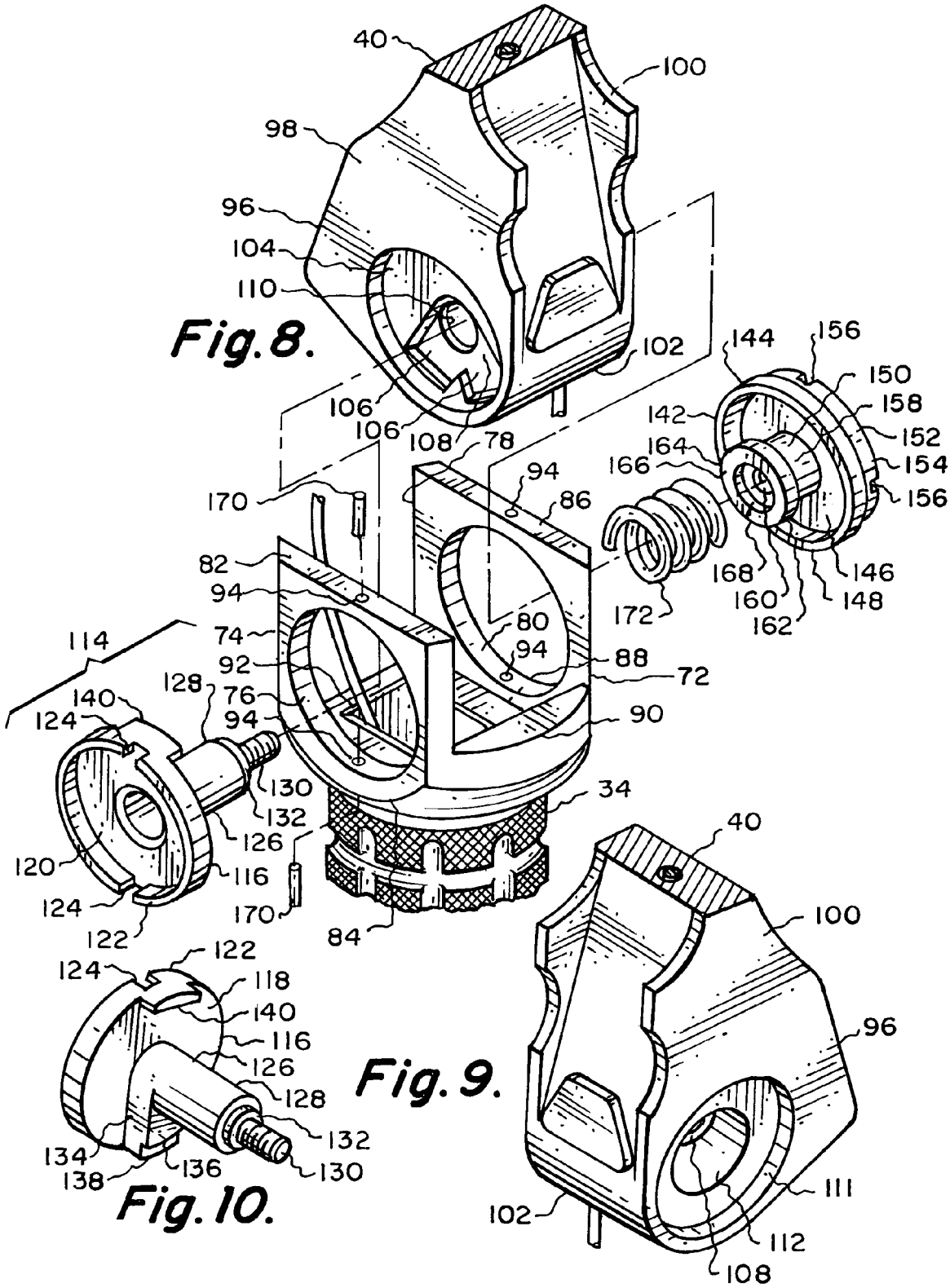
FIG. 8 is an exploded perspective view of the hinge portion of the grip in accordance with the present invention.
FIG. 9 is a reversed perspective view of the tongue portion thereof.
FIG. 10 is a reversed perspective view of the hinge pin thereof.

FIG. 8 shows an exploded perspective view of the hinge portion 36 of the grip 30 in accordance with the present invention. The second end 34 of the grip 30 forms a yoke 72 which has a left side panel 74 forming a left transverse throughbore 76 of thickness about 4.5 mm and diameter about 31.5 mm, a right side panel 78 forming a right transverse throughbore 80 also of thickness about 4.5 mm and diameter 31.5 mm, a front 90, and a rear 92. The left side panel 74 has a top surface 82 and a bottom surface 84. The right side panel 78 has a top surface 86 and a bottom surface 88. Between the left side panel 74 and the right side panel 78, the front 90 of the yoke 72 is cut down to about 23 mm below the top surfaces 82 and 86 of the side panels 74 and 78; the rear 92 of the yoke 72 is cut down to about 38 mm below the top surfaces 82 and 86 of the side panels 74 and 78. Each side panel 74 and 78 has a retainer bore 94, diameter about 2.5 mm, extending vertically from the transverse throughbore 76 and 80 to the top and bottom surfaces 82, 84, 86, and 88.

With continued reference to FIG. 8 and now also with reference to FIG. 9, a partial perspective view taken from the opposite side, a tongue 96 is formed on the stem 40 and has a left face 98 and a right face 100, spaced apart about 27.5 mm, and a half-cylindrical bottom surface 102 extending therebetween. The left face 98 has a milled left recess 104 of diameter about 31.5 mm and depth about 5.5 mm, and, cut an additional 2.5 mm rightward therein, a plurality of milled radially oriented channels 106 angularly spaced apart by about 80 degrees. The channels 106 are about 12 mm wide and intersect at the center of the left recess 104. Rightward of these channels 106, the stem 40 forms a central wall 108 of thickness about 1 mm. A left transverse center bore 110 of diameter about 11 mm is formed in the central wall 108 at the center of the left recess 104.

In the right face 100 there is formed a milled right recess 111 of diameter about 31.5 mm and depth about 2.5 mm and, centered therein, a right transverse center bore 112 of diameter about 15 mm extending leftward into the stem 40. The right transverse center bore 112 meets the left transverse center bore 110 at the central wall 108, at a depth of about 16 mm leftward of the depth of the right recess 111.

The tongue 96 fits between the left side panel 74 and the right side panel 78 of the yoke 72. The left transverse center bore 110 and the right transverse center bore 112 are centered relative to the transverse throughbores 76 and 80 in the side panels 74 and 78 of the yoke 72.

With continued reference to FIGS. 8 and 9 and now also with reference to FIG. 10, another partial reverse perspective view, a hinge pin 114 is provided and, as set forth below, will be inserted rightward to hold the tongue 96 in the yoke 72. The hinge pin 114 has a head 116 of diameter about 31 mm matched to fit in the left transverse throughbore 76 of the left side panel 74 of the yoke 72 and into the left recess 104 on the left face 98 of the tongue 96. The head 116 has a flat inner surface 118, a flat outer surface 120, and a raised periphery 122 around the outer surface 120. The raised periphery 122 has a height of about 4.5 mm. Two diametrically opposite retainer notches 124 are cut in the periphery 122.

A cylindrical shaft 126 projects from the center of the inner surface 118 of the head 116. The shaft 126, length about 30 mm from the inner surface 118 of the head 116, includes a proximal shaft portion 128, length about 20 mm, diameter about 11 mm; a distal shaft portion 130, length about 8 mm, diameter about 5 mm with external threading; and a short intervening shaft portion 132, length about 1-2 mm, diameter about 9 mm.

With continued reference to FIG. 9 and now also with reference to the reversed perspective view of the hinge pin 114 shown by FIG. 10, a raised stop 134 is formed on the inner surface 118 of the head 116. The stop 134 extends radially from the shaft 126 to the periphery 122 of the head 116. The stop 134 includes a proximal stop portion 136, about the first 9 mm from the shaft 126, which is raised about 5 mm from the inner surface 118 of the head 116. The stop 134 includes a distal stop portion 138, about the distal 1.5 mm of the stop 134, which is raised about 2.5 mm from the inner surface 118 of the head 116. The stop 134 is about 11 mm wide.

Diametrically opposite the stop 134, a tooth 140 is formed on the inner surface 118 of the head 116 at the periphery 122. The tooth 140 is raised about 2.5 mm from the inner surface 118 of the head 116, the same height as the distal portion of the stop 134.

A closed nut 142 is provided and, as set forth below, will be used to hold the hinge pin 114 in place. The nut 142 has a head 144, diameter about 31 mm, having a flat inner surface 146, a raised inner rim 148, and a sleeve 150 projecting leftward from the center of the inner surface 146 to a distance of about 5 mm beyond the level of the inner rim 148. The nut 142 also has a flat outer surface 152 with a raised periphery 154 having four key notches 156 cut into it to permit the engagement of a cruciform key (not shown) for tightening and loosening the nut 142.

The sleeve 150 includes a proximal sleeve portion 158, length about 2.5 mm, diameter about 9 mm, forming a sleeve bore 160 of diameter about 5 mm having internal threading; and a distal sleeve portion 162, length about 2.5 mm forming a flange 164 of diameter about 15 mm, which diameter is matched to diameter of the right transverse center bore 112 of the tongue 96. The flange 164 has a leftward facing inner surface 166, the central 9 mm of which is milled to form a flange recess 168 of depth 1-2 mm surrounding the internally threaded sleeve bore 160. The diameter of the flange recess 168 is matched to that of the intervening shaft portion 132.

After the tongue 96 is placed in the yoke 72, the hinge pin 114 is inserted through the left transverse throughbore 76 of the yoke 72 and into the left recess 104 of the tongue 96, oriented so that the retainer notches 124 are aligned with the retainer bores 94 of the left side panel 74 of the yoke 72. With the hinge pin 114 so oriented, the stop 134 on the inner surface 118 of the head 116 of the hinge pin 114 sinks into one of the channels 106 in the left recess 104 of the tongue 96. The shaft 126 now extends through the left transverse center bore 110 and into the right transverse center bore 112. One retainer pin 170 is lodged in each retainer bore of the left side panel 74 of the yoke 72. Each retainer pin 170 extends into one of the retainer notches 124 in the periphery 122 of the head 116 of the hinge pin 114. As a result, the hinge pin 114 is retained on the yoke 72 and is prevented from rotating relative to the yoke 72.

A metal helical spring 172, outside diameter 15 mm, inside diameter 13.5 mm, length 14 mm, is inserted into the right transverse center bore 112 of the tongue 96 and is advanced leftward until it encounters the central wall 108 of the tongue 96. The spring 172 is now positioned around the shaft 126 of the hinge pin 114.

The nut 142 is inserted through the right transverse throughbore 80 of the right side panel 78 of the yoke 72 and into the right recess 111 of the tongue 96. The flange 164 of the sleeve 150 of the nut 142 passes into the right transverse center bore 112, where it encounters the spring 172. The internally threaded sleeve bore 160 engages the externally threaded distal shaft portion 130. The nut 142 is turned onto the shaft 126 until the intervening shaft portion 132 occupies the flange recess 168. A cruciform key (not shown) or other suitable tool is used to engage the key notches 156 in the periphery 154 of the nut 142 and is used to tighten the nut 142 on the shaft 126. When this is accomplished, the spring 172 is compressed between the flange 164 and the wall of the tongue 96. The spring 172 therefore biases the flange 164, and thus the nut 142 and the hinge pin 114, rightward relative to the tongue 96, firmly seating the stop 134 of the hinge pin 114 in the channel of the left recess 104 of the tongue 96.

Figure 11:
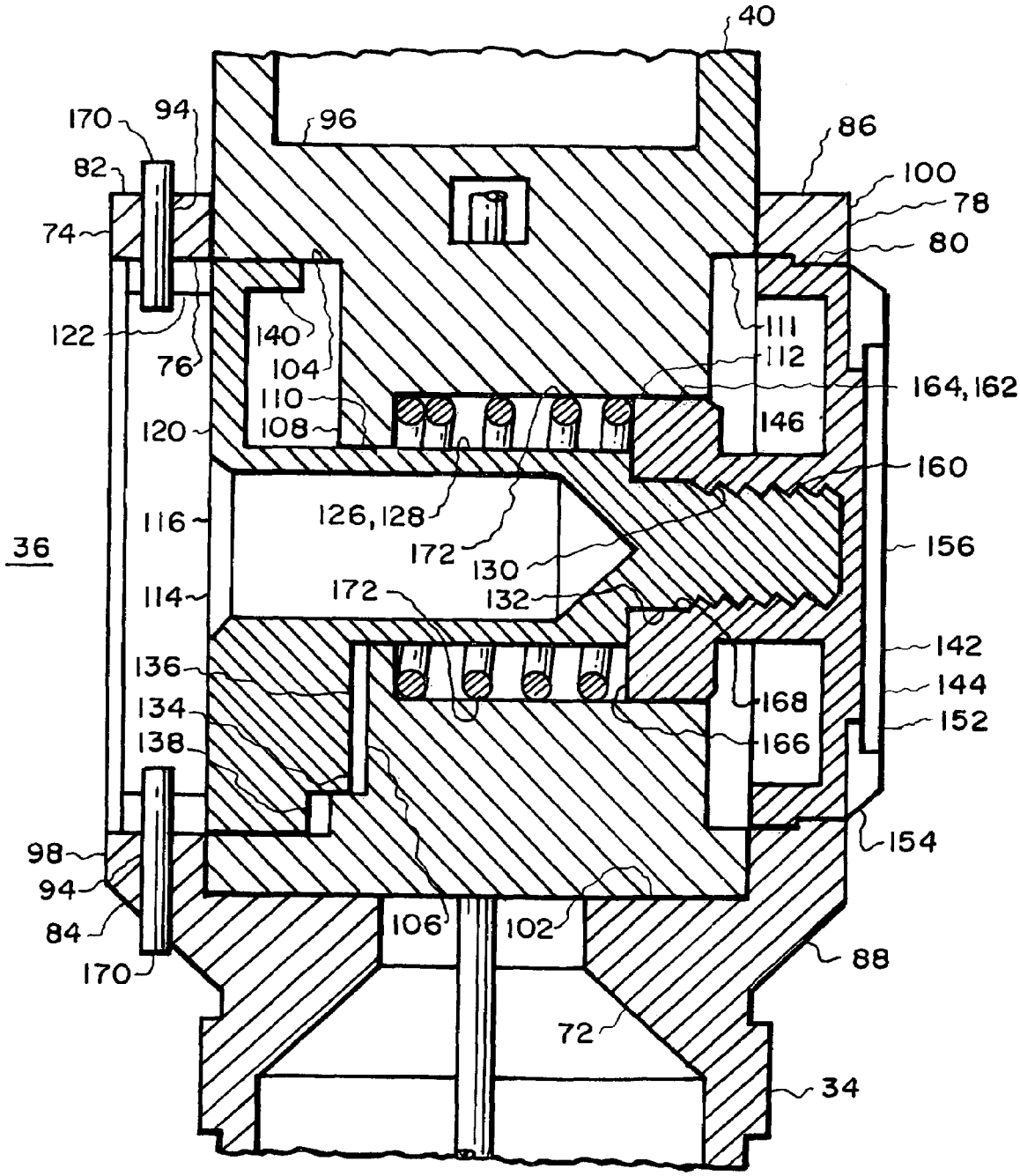
FIG. 11 is a front sectional view of the hinge and the release taken along line 11-11 of FIG. 4 in the direction of the appended arrows.
Figure 12:
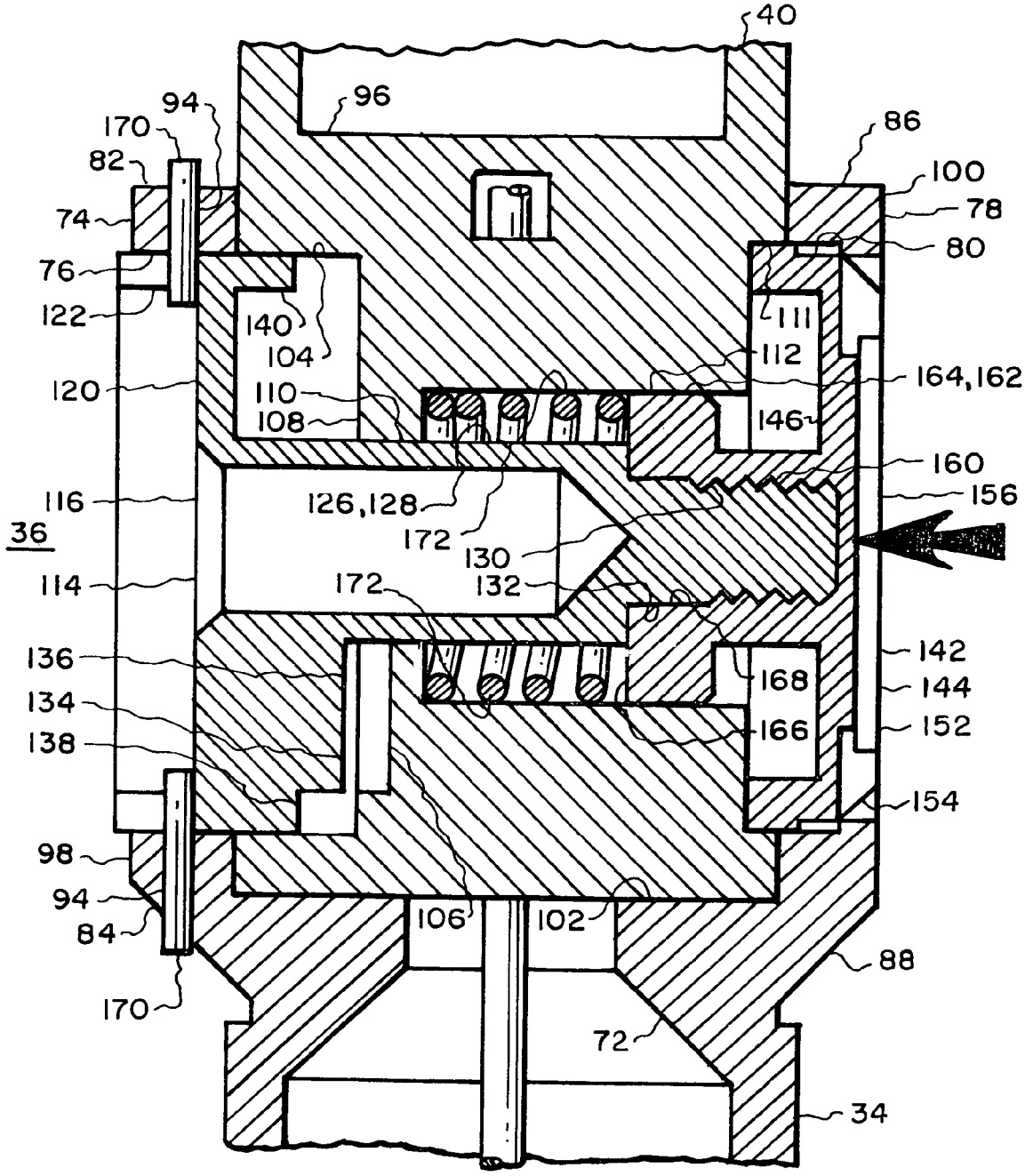
FIG. 12 is a front sectional view of the hinge and the release taken along line 11-11 of FIG. 4 in the direction of the appended arrows.

FIGS. 11 and 12 are front sectional views of the hinge portion 36 locked and unlocked, respectively. FIGS. 11 and 12 both show the hinge 36, stem 40, yoke 72, left side panel 74, left transverse throughbore 76, right side panel 78, right transverse throughbore 80, top surface (of left side panel) 82, bottom surface (of left side panel) 84, top surface (of right side panel) 86, bottom surface (of right side panel) 88, retainer bore 94, tongue 96, left face 98, right face 100, bottom surface (tongue) 102, left recess 104, channels 106, central wall 108, left transverse center bore 110, right recess 111, right transverse center bore 112, hinge pin 114, head (of hinge pin) 116, inner surface (of head) 118, outer surface (of head) 120, periphery (of head) 122, retainer notches 124, shaft 126, proximal shaft portion 128, distal shaft portion 130, intervening shaft portion 132, stop 134, proximal stop portion 136, distal stop portion 138, tooth 140, nut 142, head (of nut) 144, inner surface (of nut) 146, inner rim (of nut) 148, sleeve 150, outer surface (of nut) 152, periphery (of nut) 154, key notches 156, proximal sleeve portion 158, sleeve bore 160, distal sleeve portion 162, flange 164, inner surface (of flange) 166, flange recess 168, retainer pin 170, and spring 172.

With reference to FIG. 11, as long as the stop 134 (see FIG. 10) is seated in a channel 106 (see FIG. 8), the tongue 96 will not rotate relative to the yoke 72 and, therefore, the stem 40 will not rotate relative to the grip 30. However, with reference to FIG. 12, a person may press leftward on the nut 142, further compressing the spring 172 and urging the hinge pin 114 leftward until the stop 134 disengages from the channel. The person may then rotate the stem 40 relative to the grip 30 and withdraw the pressure from the nut 142. When the hinge pin 114, again biased rightward by the spring 172, rotates into position over a channel 106, the stop 134 seats in the channel 106, once again fixing the stem 40 relative to the grip 30.

With reference again to FIG. 8, this exemplary embodiment of the present invention has two channels 106 machined such that the two rotational positions of the stem 40 relative to the grip 30 will aim the lamp mount 42 about 17 and about 83 degrees, respectively, from the longitudinal axis of the grip 30.

Figure 13:
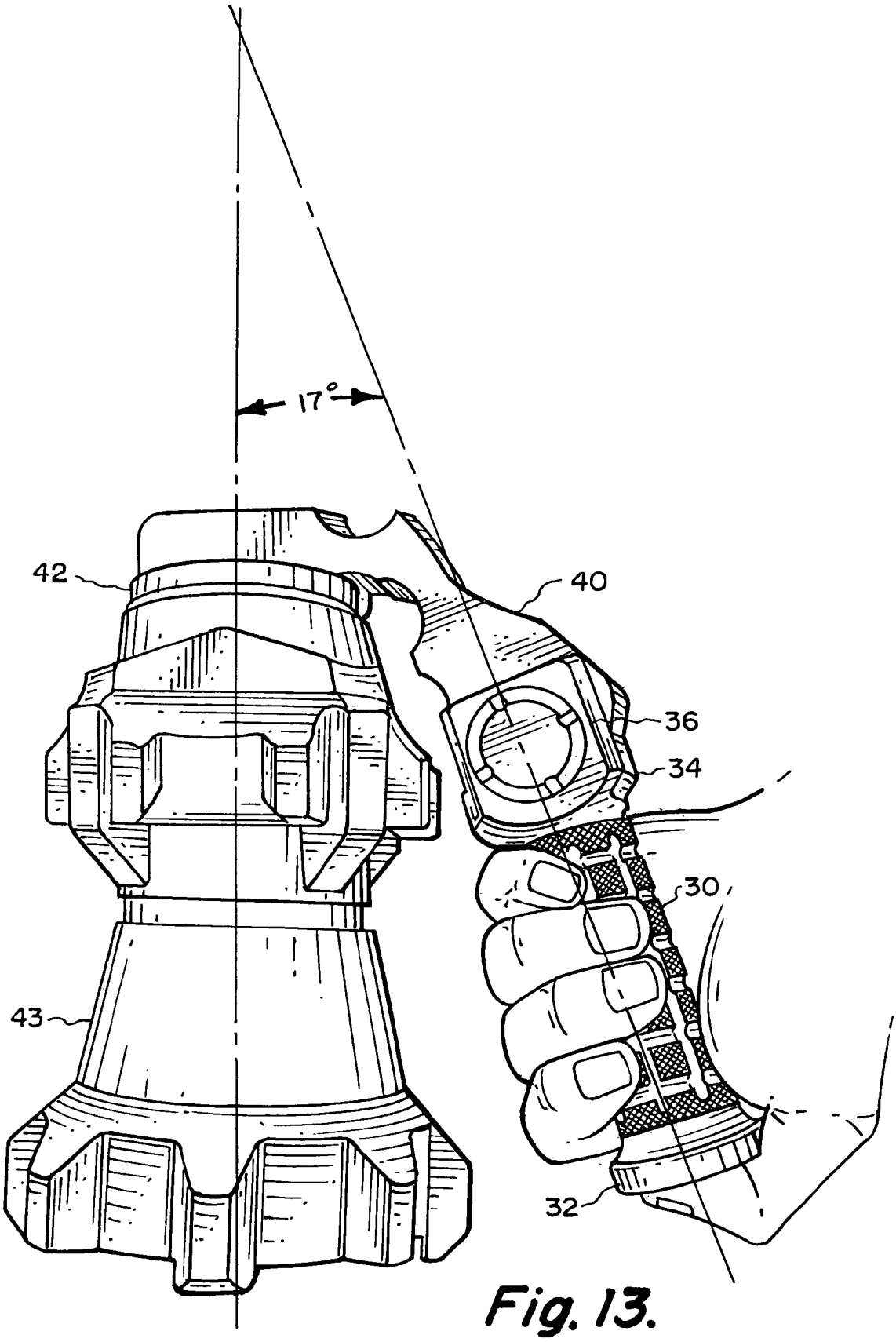
FIG. 13 is a perspective view of a searchlight incorporating a multi-position searchlight grip 20 in accordance with the present invention being hand held in a first orientation.

With reference to FIG. 13, a perspective view of a searchlight incorporating a multi-position searchlight grip 20 in accordance with the present invention being hand held with the hinge 36 locked at the 17-degree setting, one may, for example, hold the grip 30 with one's thumb proximate the first end 32 of the grip 30. If one holds the searchlight in this manner with one's arm extending downward at one's side and the grip 30 oriented horizontally, the lamp mount 42 and the lamp module 43 will point generally forward and slightly downward. This comfortable, relaxed hold on searchlight is useful for navigation while walking over terrain.

Figure 14:
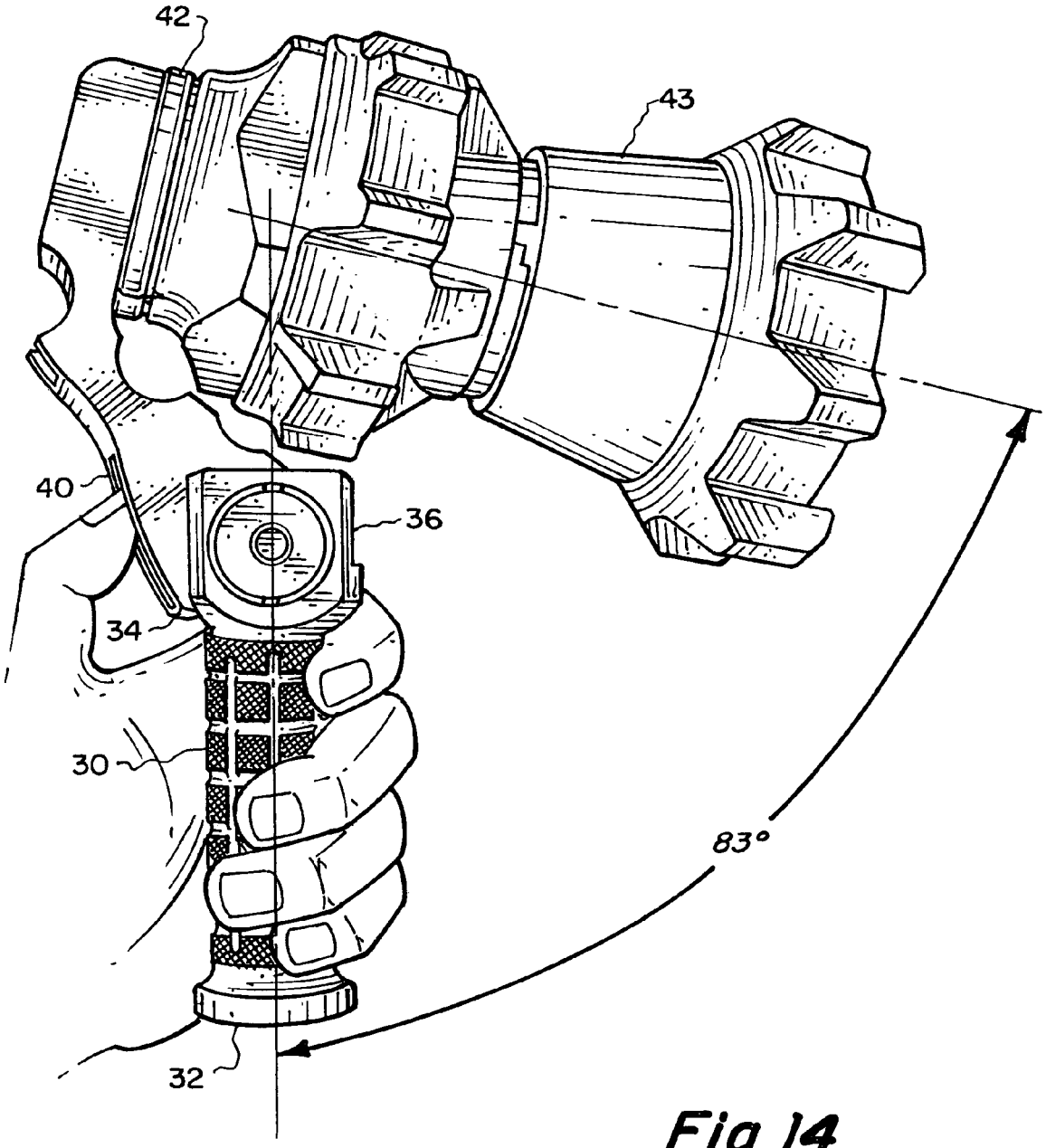
FIG. 14 is a perspective view of a searchlight in accordance with the present invention being hand held in an orientation different from that shown in FIG. 13 and with the hinge locked in a different position.

With reference to FIG. 14, a perspective view of a searchlight in accordance with the present invention being hand held in a manner opposite that shown in FIG. 13 with the hinge 36 locked in the 83-degree setting, one may, for example, hold the grip 30 with one's thumb proximate the second end 34 of the grip 30. If one holds the searchlight in this manner with one's forearm extending forward or upward and the grip 30 oriented vertically, the lamp mount 42 and the lamp module 43 will again point generally forward and slightly downward. This manner of carrying the searchlight is consistent with pointing a spotlight at an object of interest some distance ahead.

While the foregoing detailed description has described several embodiments of a multi-position searchlight grip in accordance with the present invention, it is to be understood that the above description is illustrative only and not limiting of the disclosed invention. Indeed, it will be appreciated that the embodiments discussed above and the virtually infinite embodiments that are not mentioned could easily be within the scope and spirit of the present invention. Thus, the present invention is to be limited only by the claims as set forth below.

What is claimed is:

1. A searchlight grip, comprising:

an elongated grip body having a first end and a second end, said second end adapted for attaching a lamp to said grip body;

a first ON/OFF switch and a second ON/OFF switch carried by said grip body;

a first actuator for said first switch, said first actuator positioned on said grip body in the vicinity of said first end;

a second actuator for said second switch, said second actuator positioned on said grip body in the vicinity of said second end; and an electrical circuit including said first switch, said second switch, said lamp attached to said grip body, and a power source.

2. A searchlight grip as set forth in claim 1, wherein each of said first actuator and said second actuator includes a push-button.

3. A searchlight grip as set forth in claim 1, wherein said electrical circuit is operatively connected in substantially the same manner to each of said first switch and said second switch.

4. A searchlight grip as set forth in claim 1, including a stem rotatably connected to said second end and a lamp mount formed on said stem for attaching said lamp to said grip body.

5. A searchlight grip as set forth in claim 1, wherein:

said electrical circuit includes a first power input, a second power input, a first power output, and a second power output;

said electrical circuit is operable in an ON state wherein said first power input is electrically connected to one of said first power output and said second power output, and said second power input is connected to the other of said first power output and said second power output;

said electrical circuit is operable in an OFF state, wherein at least one of said first power input and said second power input is electrically disconnected from both of said first power output and said second power output; and a single operation of one of said first actuator and said second actuator causes said electrical circuit to alternate from one to the other of said ON state and said OFF state.

6. A searchlight grip as set forth in claim 5, wherein each of said first actuator and said second actuator includes a push-button.

7. A searchlight grip as set forth in claim 5, including a stem rotatably connected to said second end and a lamp mount formed on said stem for attaching said lamp thereto.

8. The searchlight grip as set forth in claim 1, wherein said electrical circuit is configured to effect said connecting and disconnecting upon actuation of either one of said first actuator and said second actuator.

9. The searchlight grip as set forth in claim 1, wherein said electrical circuit is configured to effect said connecting upon actuation of both of said first actuator and said second actuator.

10. A searchlight, comprising:

a grip body;

operatively coupled to said grip;

a hinge pin movably disposed through said grip body and through said lamp portion, said hinge pin biased in a first position wherein said hinge pin rotationally fixes said lamp portion to said grip body; and a depressible member carried by said grip body for urging said hinge pin against the bias to a second position wherein said lamp portion is rotatable relative to said grip body a first ON/OFF switch and a second ON/OFF switch carried by said grip body; a first end formed on said grip body and including a first for said first switch; a second end formed on said grip body and including a second actuator for said second switch; a lamp portion including a lamp coupled to said second end of said grip body; a circuit coupling said first switch, said second switch and said lamp portion for connecting said lamp to a power source connected in said circuit upon selective actuation of said first actuator and said second actuator.

11. A searchlight as set forth in claim 10, wherein:

one of said lamp portion and said grip body has a tongue, the other of said lamp portion and said grip body has a yoke, and said tongue is disposed in said yoke.

12. A searchlight as set forth in claim 11, wherein:

said hinge pin is disposed through said tongue and said yoke, and said hinge pin cooperates with said tongue and said yoke to define an axis of rotation of said tongue relative to said yoke.

13. A searchlight as set forth in claim 12, wherein:

said hinge pin is rotationally fixed relative to said yoke, and said hinge pin is movable, parallel said axis of rotation, relative to said yoke, between said first position and said second position.

14. The searchlight as set forth in claim 12, wherein said hinge pin includes a stop and said tongue includes a first channel and a second channel angularly spaced from said first channel, each of said first channel and said second channel configured for alternatively receiving said stop for rotationally fixing said lamp portion to said grip body.

15. The searchlight as set forth in claim 14, wherein each of said first channel and said second channel radially extends with respect to said axis.

16. The searchlight as set forth in claim 15, wherein said stop radially extends with respect to said axis.

17. A searchlight comprising:

an elongated grip body;

a first ON/OFF switch and a second ON/OFF switch carried by said grip body;

a first end formed on said grip body and including a first actuator for said first switch;

a second end formed on said grip body and including a second actuator for said second switch;

a searchlight head including a lamp coupled to said second end of said grip body; and a circuit coupling said first switch, said second switch and said searchlight head for connecting said lamp to a power source connected in said circuit upon selective actuation of said first actuator and said second actuator.

18. A searchlight as set forth in claim 17, wherein each of said first switch actuator and said second switch actuator is push-button operable.

19. A searchlight as set forth in claim 17, including a selectively actuable mechanism pivotally coupling said head to said second end in at least two alternative angular positions of said head with respect to said grip body.

20. A searchlight as set forth in claim 19, wherein each of said first switch actuator and said second switch actuator is push-button operable.

21. A searchlight as set forth in claim 17, wherein said selectively actuable mechanism is push-button operable.

* * * * *

UNITED STATES PATENT AND TRADEMARK OFFICE

CERTIFICATE OF CORRECTION

PATENT NO. : 7,334,915 B2
APPLICATION NO. : 11/034004
DATED : February 26, 2008
INVENTOR(S) : Paul Y. Kim It is certified that error appears in the above-identified patent and that said Letters Patent is hereby corrected as shown below:

At column 10, line 29, after "a grip body;" insert

--a first ON/OFF switch and a second ON/OFF switch carried by said grip body; a first end formed on said grip body and including a first actuator for said first switch; a second end formed on said grip body and including a second actuator for said second switch; a lamp portion including a lamp coupled to said second end of said grip body; a circuit coupling said first switch, said second switch and said lamp portion for connecting said lamp to a power source connected in said circuit upon selective actuation of said first actuator and said second actuator;--

Col. 10 line 30, "operatively coupled to said grip" should be deleted

Col. 10 line 38, after "grip body" delete "a first ON/OFF switch and a second ON/OFF"

Col. 10 lines 39-47, the entirety of these lines should be deleted

Col. 10 line 48, "second actuator" should be deleted

Signed and Sealed this

Twenty-fourth Day of June, 2008

JON W. DUDAS
*Director of the United States Patent and Trademark Office*